United States Patent [19]

Kiyono

[11] Patent Number: 4,909,513

[45] Date of Patent: Mar. 20, 1990

[54] AUTOMATIC PLAYING MACHINE USING DICE

[75] Inventor: Shozo Kiyono, Ichikawa, Japan

[73] Assignee: Fuji Electronic Industry Co., Ltd., Ichikawa, Japan

[21] Appl. No.: 240,211

[22] Filed: Sep. 6, 1988

[30] Foreign Application Priority Data

Oct. 5, 1987 [JP] Japan ..... 62-251392

[51] Int. Cl.[4] ..... A63F 9/04

[52] U.S. Cl. ..... 273/145 R; 273/1 M; 273/138 A

[58] Field of Search ..... 273/1 R, 1 M, 145 R, 273/145 B, 138 R, 138 A, 144 R, 144 A, 145 E, 145 D; 364/412

[56] References Cited

U.S. PATENT DOCUMENTS 2,135,182 11/1938 Joze ..... 273/145 R
2,302,333 11/1942 Linke ..... 273/138 A
2,693,962 11/1954 Stevens ..... 273/145 D

FOREIGN PATENT DOCUMENTS 617098 5/1980 Switzerland ..... 273/138 A

*Primary Examiner*—Edward M. Coven
*Assistant Examiner*—Valerie A. Szczepanik
*Attorney, Agent, or Firm*—Robbins & Laramie

[57] ABSTRACT

An automatic playing machine for playing dice games is provided that includes a plurality of dice, each of which is provided with an arrangement of one or more spots on at least one die surface. Each die is provided with a magnet mounted therein for directing the display of dice on a game board in accordance with the manner determined at random by a digital computing system. A magnetic field generating system positioned about the periphery of the game board ensures that dice cast onto the game board rest thereon in accordance with the manner selected by the computing system. A dice recovery and sorting system is provided to remove the dice from the game board and sort the dice for storage in accordance with the configuration of spot(s) thereon.

12 Claims, 7 Drawing Sheets memory RAM
memory ROM
CPU
I/O PORT FOR OUTPUT
M1 (Belt conveyer 2)
M2 ( " 6)
M3 ( " 9)
M4 ( " 15)
Magnetic field generating means 1
gate 19
dice ejecting plunger 21
dice casting plunger 28
control of vertical movement
M5 (elevating bed)
I/O PORT FOR INPUT
detector 8
edge detector 13
dice spot detector 12
start switch

AUTOMATIC PLAYING MACHINE USING DICE

BACKGROUND OF THE INVENTION

1. Field of the Invention

This invention relates to an automatic playing machine, and more particularly to a playing machine for automatically playing games using dice.

2. Description of the Prior Art

No playing machine for automatically playing games using dice has heretofore been known to have been developed. This is due to the fact that it was believed to be impossible to automatically control the number of spot(s) appearing on the top of one or more dice after being cast, and there was no appropriate method for automatically reading the number of spot(s) on the top of the one or more dice cast, thus making it impracticable to automate such playing machines.

If a controllable planar image is used instead of actual dice to indicate a predetermined number of spot(s) on a die after casting, it becomes possible to provide a playing machine for automatically playing a game using imaged dice.

In that case, however, the player cannot enjoy such three-dimensional feeling as that experienced by using actual dice, thus impairing the fun of the game.

There have been known dice, each having a magnet or weight mounted therein, which indicate a predetermined number of spot(s) thereon after being cast. However, since it is difficult to cast the dice onto a board member and to automatically recover the dice into the playing machine, no automatic playing machine of the kind specified has so far been developed.

SUMMARY OF THE INVENTION

Accordingly, the present invention has for its object to provide an automatic playing machine using three dimensional dice, each die having a predetermined number of spots formed thereon in which the machine includes a mechanism for casting the dice that is adapted to indicate a number of spot(s) preset by means of a computer. Means is also provided for automatically recovering the dice into the playing machine.

According to the present invention, there is provided an automatic playing machine having a plurality of dice, each die having a magnet mounted therein for effecting indication of a predetermined number of spot(s) thereon after being cast on a board member. The numbers of spot(s) appearing on the dice is preset by means of a computer, and the dice are adapted to indicate the preset number as they are cast on the board member for playing. The game includes dice housing means for accommodating dice, which have been sorted and arranged therein in accordance with their number of spot(s), and for ejecting dice in accordance with a number preset by the command of the computer; a dice casting means for casting the ejected dice onto the board member; a magnetic field generating means disposed in the periphery of said board member and adapted to apply an electromagnetic force on the board member to enable the dice cast by the dice casting means to rest on the board member with the top surface having the predetermined number of spot(s) thereon; means for recovering the dice resting on the board member and transferring them into the dice housing means; and means for sorting the recovered and transfered dice by their predetermined number of spot(s) and for accommodating the dice into the dice housing means.

Thus, the present invention provides an automatic playing machine capable of automatically playing games with the same three-dimensional feeling as that which the player can experience when using actual dice.

The present invention will now be described by way of example only with reference to the accompanying drawings.

DETAILED DESCRIPTION OF THE PREFERRED EMBODIMENTS

Figure 1:
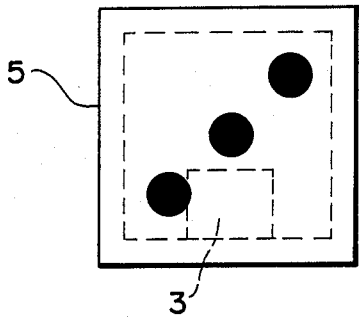
FIG. 1 is a side elevational view of a single die for use with an automatic playing machine according to the present invention.
Figure 2:
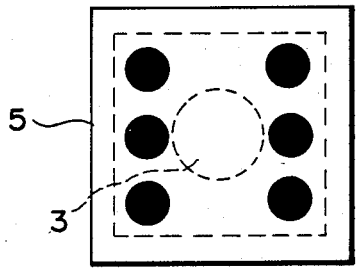
FIG. 2 is a bottom view of the die shown in FIG. 1.

FIGS. 1 and 2 show a dice 5 for use in the present invention. The die shown is of a regular hexahedron configuration and has one to six spots, respectively, indicated on each of the six faces thereof. The die 5 is hollow and has a magnet 3 mounted on the rear side of a particular face. The die shown in this embodiment has a magnet 3 mounted on the rear of the face having six spots thereon so that the single spot on the opposite face is shown after the die is cast on a magnetized object.

According to this embodiment, since five dice are cast at the same time and at least six dice are necessary for each of the predetermined number of spot(s) from one to six inclusive, at least thirty pieces of dice are necessary.

Figure 3:
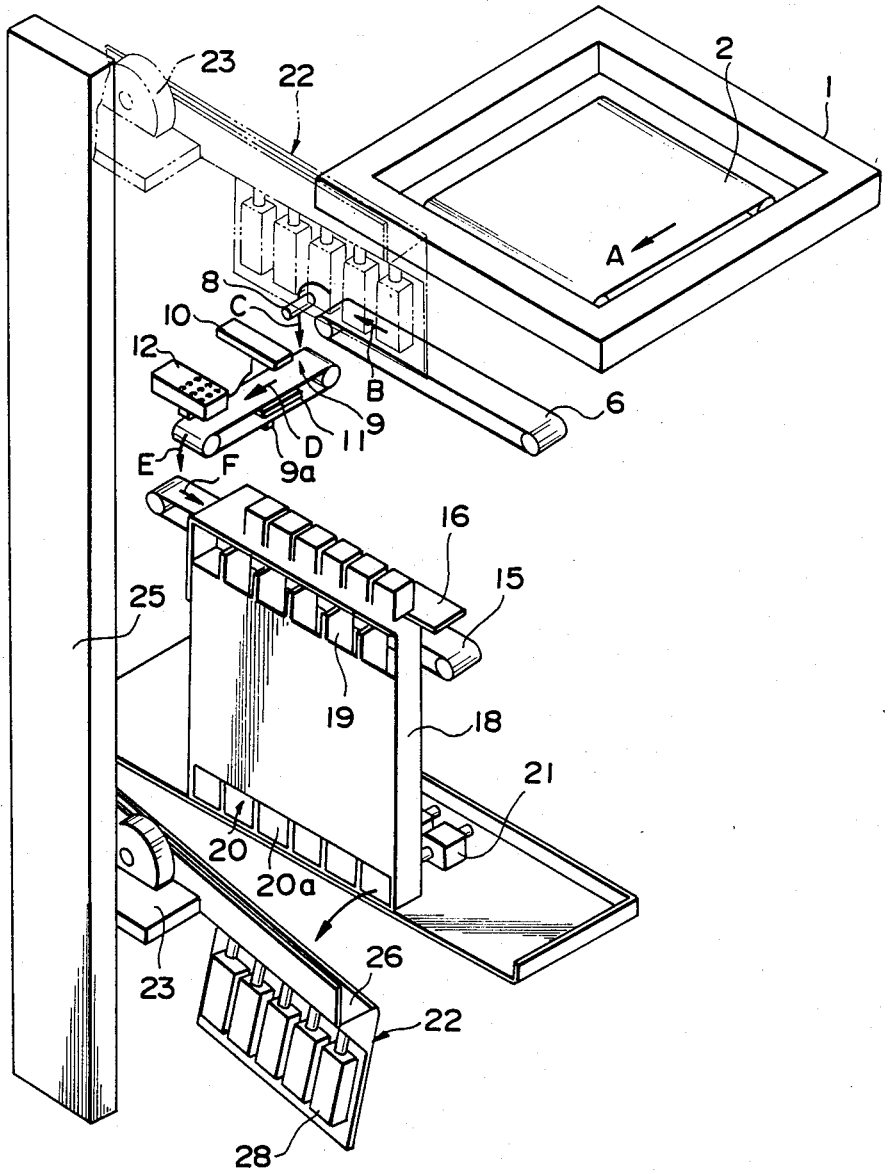
FIG. 3 is a schematic perspective view of an automatic playing machine according to the present invention.

Referring to FIG. 3, there is schematically illustrated an automatic playing machine according to the present invention. Located above the automatic playing machine is a magnetic field generating means 1 of a rectangular frame shape, inside of which a first belt conveyor 2 is horizontally located. The first belt conveyor 2 serves as a board member on which dice are cast when the belt conveyor is at rest, and also acts as a die recovering means during its movement in the direction shown by arrow A.

A second conveyor 6 is horizontally located below the downstream end of the first conveyor belt 2 and at a right angle to the latter. The second belt conveyor 6 is driven by means of a driving motor M2 (FIG. 4) so as to travel in the direction shown by an arrow B. Located close to the downstream end of the second belt conveyor 6 is a detector 8 which is adapted to transmit a signal to stop the conveyor 6 each time when a die 5 passes nearby.

Directly below the detector 8 and at a right angles to the second belt conveyor 6 and also on the opposite side of the first belt conveyor 2, there is horizontally located a third belt conveyor 9, which is arranged to be driven by means of a driving motor M3 (FIG. 4) so as to move in the direction shown by an arrow D. Further, the third belt conveyor 9 has a small projection 9*a* formed as an integral part thereof, which extends at a right angle to the direction of movement of the conveyor 9. In the proximity of the upstream end of the third belt conveyor 9, a pair of upper and lower magnets (ferrite magnets) 10 and 11 are located above and below the transferring surface of the third belt conveyor 9. The upper magnet 10 is located at a position which does not interfere with the dice 5 carried by the third belt conveyor 9.

Stating in brief, a gap is provided between the magnet 10 disposed above the belt conveyor 9 and a die 5 placed on the belt 9, so that even when a change in posture of the die about its diagonal line occurs, the dice is not allowed to contact the magnet 10. When the opposed magnetic poles of the die and the magnet are different from each other, the attraction force exerted by the magnet 10 is too small to attract the die, whereas when the opposed magnetic poles of the die and the magnet are identical, a repulsive force enough to roll or tumble the dice can be exerted. Further, in the vicinity of the downstream end of the third belt conveyor 9 and above the upper moving surface of the latter there is located a dice spot detector 12 adapted to detect the number of spot(s) 5*a* on the die 5, i.e., the number of spot(s) indicated on the face opposite to one side face having the magnet 3 mounted thereon. Moreover, a dice edge detector 13 (FIGS. 7A and 8) is located below the dice spot detector 12 and at a position in alignment with the front edge of the die 5 resting on the third belt conveyor 9.

Just below the downstream end of the third belt conveyor 9 and at right angles to the latter is horizontally disposed a fourth belt conveyor 15 which is driven by means of a driving motor M4 (FIG. 4) so as to move in the direction shown by an arrow F. A gate controller 16 is located above and along the upper moving surface of the fourth belt conveyor 15. The gate controller 16 is adapted to receive a signal indicative of a predetermined number of spot(s) on the die 5 transmitted by the spot detector 12 so as to open one of a plurality of gates 19 provided in a dice housing means 18 described in detail hereinbelow, at a position corresponding to the predetermined number of spot(s).

The dice housing means 18 is located adjacent to the gate controller 16 and extends at a right angle to the fourth belt conveyor 15 and downwardly. The dice housing means 18 has six gates 19 and six chambers 20 adapted to accommodate six dice 5 each having a different predetermined number of spot(s) thereon. On the opposite side of openings 20*a* of the six chambers 20, six dice ejecting plungers 21 are located, respectively, in such a manner that the loading end of each of the plunger extends partially into each of the chambers 20. A dice casting stand 22 is located at a position opposite to the openings 20*a* formed, respectively, in the six chambers 20 of the dice housing means 18. The dice casting stand 22 is fixedly secured to an elevating stand 23. The elevating stand 23 is adapted to be moved up and down by means of a driving motor M5 (FIG. 4) along a vertically located post 25 so that the dice casting stand 22 may be lifted to a position in the vicinity of the downstream end of the first belt conveyor 2 as shown in phantom in FIG. 3. The dice casting stand 22 has a dice resting surface 26 on which five dice 5 ejected from the dice housing means 18 are placed, and five dice casting plungers 28 located in such a manner that their loading ends extend partially through the dice resting surface 26.

Figure 4:
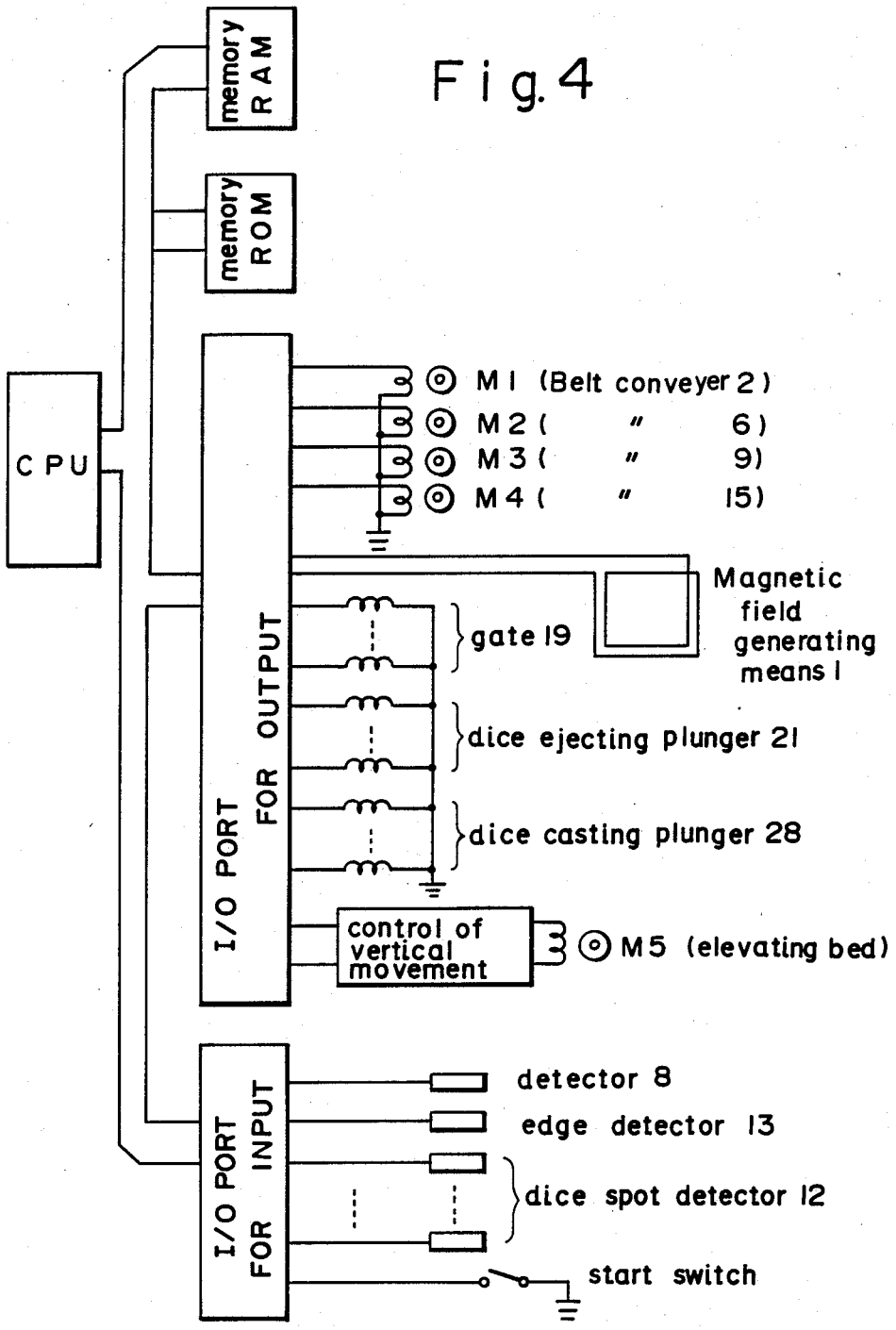
FIG. 4 is a block diagram of an electronic control circuit for the computer used in the automatic playing machine shown in FIG. 3.

FIG. 4 is a block diagram of an electronic control circuit for a computer used in the present invention. CPU is a central processing unit for effecting controls of each program etc. RAM is a temporary storage unit adapted to temporarily store program executing processes and the results thereof. I/O port consists of input and output ports. Electrically connected with the I/O port for output are the motors M1, M2, M3 and M4 for driving the first, second third and fourth belt conveyors 2, 6, 9 and 15, respectively, the gate 19, the dice ejecting plungers 21, the dice casting plungers 28, a magnetic field generating means 1 and the driving motor M5. Electronically connected with the I/O port for input are the detectors 8, 12 and 13, and a starting switch connected with a power supply for controlling purposes, respectively.

Figure 5:
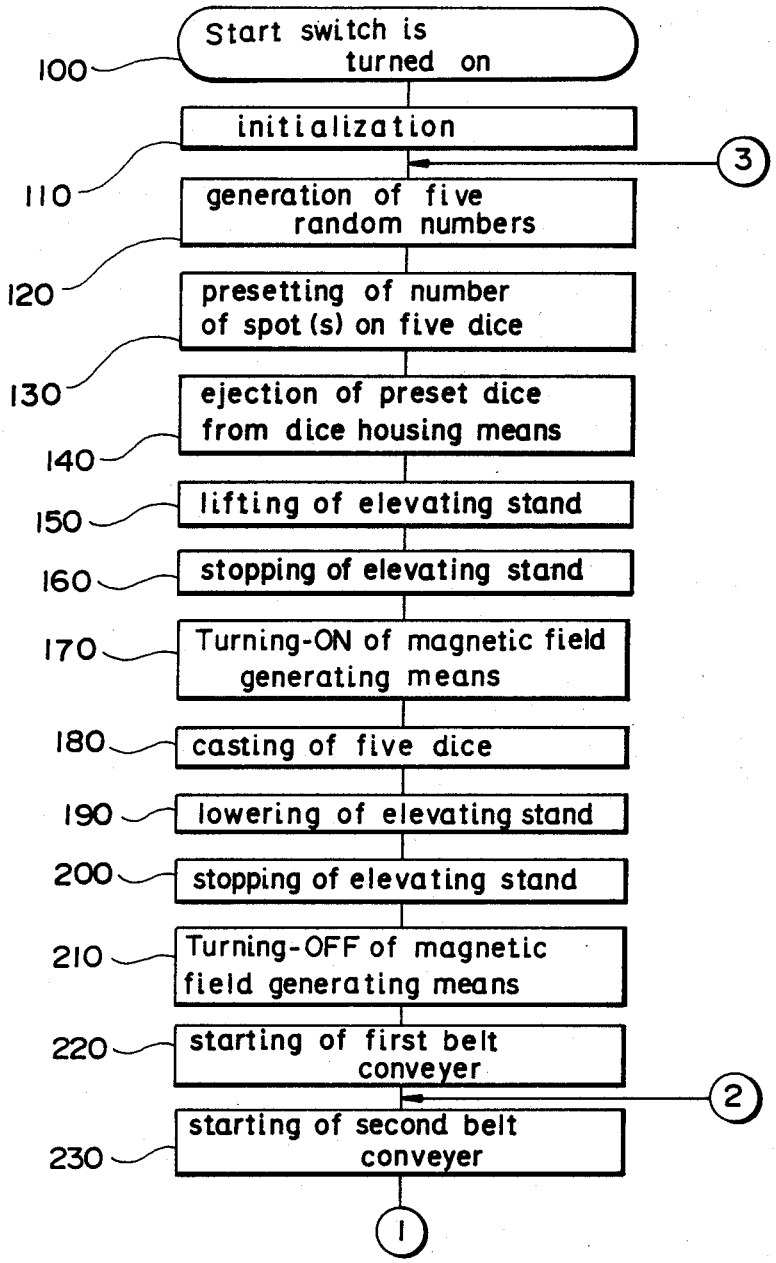
FIGS. 5 and 6 are flow charts showing the operation of the playing machine of the present invention.
Figure 6:
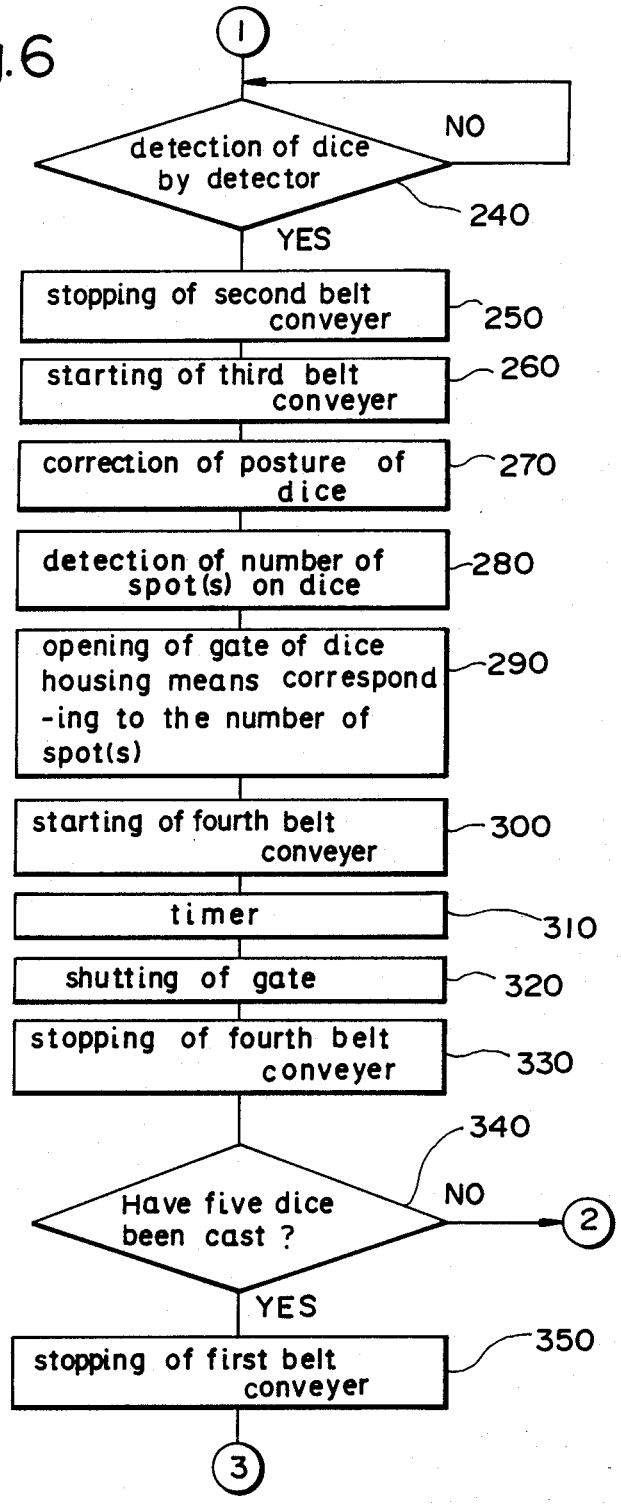

The operation of the above-mentioned embodiment of the present invention will now be described below with reference to the flow charts as shown in FIGS. 5 and 6.

When the starting switch is turned on (STEP 100), initialization of RAM and I/O port etc. is made (STEP 110). In the next step, generation of five random numbers is made by means of CPU (STEP 120), to thereby decide or pre-set randomly the predetermined number of spot(s) 5*a* to be indicated, respectively, on dice after being cast (STEP 130). The five dice ejecting plungers 21 corresponding to the chambers 20 each of which accommodates therein up to five dice 5 each having a corresponding predetermined number of spot(s) thereon are rendered operative by the command of the computer so that the dice are ejected by the dice ejecting plungers 21 from the dice housing means 18 onto the dice resting surface 26 of the dice casting means 22 (STEP 140). The dice ejecting plungers 21, which have ejected the dice 5, are then turned off immediately.

When the five designated dice 5 have been placed on the dice resting surface 26, the elevating stand 23 is lifted by the starting of the driving motor M5 to a position opposite the downstream end of the first belt conveyor 2 as shown by imaginary lines in FIG. 3 (STEP 150), and stopped at this position (STEP 160). At that time, the magnetic field generating means 1 is turned on to generate a magnetic field (STEP 170). The dice casting plungers 28 are turned on so that the five dice 5 are cast by means of the dice casting plungers 28 from the dice resting surface 26 of the dice casting stand 22 (STEP 180) onto the first belt conveyor 2. The five dice 5 resting on the first belt conveyor 2 indicate their respective predetermined number of spot(s) thereon by the cooperation of their magnets 3 and the magnetic field generated by the magnetic field generating means 1. Immediately thereafter, the elevating stand 23 is lowered again to the position shown by the solid line in FIG. 3 by the action of the driving motor M5 (STEP 190), and stopped at this lower position (STEP 200). Simultaneously therewith, the magnetic field generating means 1 is turned off thus deenergizing the magnetic field (STEP 210).

After the game is finished, the first belt conveyor 1 serving as the recovering means is driven by starting of the driving motor M1 so as to run in the direction shown by the arrow A (STEP 220), with the result that the five dice 5 are cast onto the second belt conveyor 2 which is moved by means of the driving motor M2 in the direction shown by the arrow B (STEP 230). The five dice 5 placed on the second belt conveyor 6 are detected by the detector 8 one by one (STEP 240). Each time one of the dice 5 is detected by the detector 8, the motor M2 is stopped to stop the second belt conveyor 6 (STEP 250). The die 5 which has been detected by the detector 8 will drop in the direction shown by an arrow C onto the third belt conveyor 9, which is moved by starting of the driving motor M3 in the direction shown by an arrow D (STEP 260).

Figure 7A:
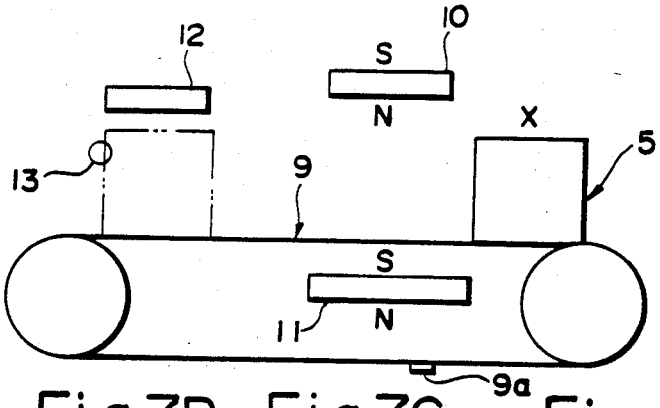
FIGS. 7A, 7B, 7C, 7D, 7E and 7F are explanatory views showing the operation of a dice posture controlling mechanism forming part of the dice transfering means according to the present invention.
Figure 7B:
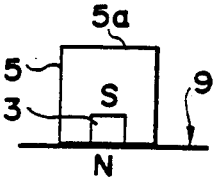
Figure 7C:
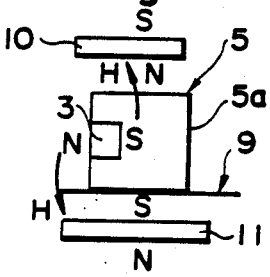
Figure 7F:
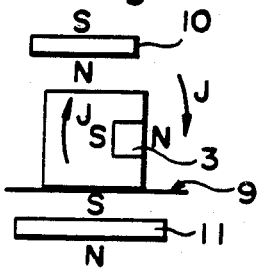
Figure 7D:
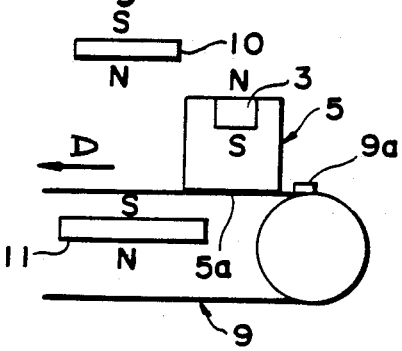
Figure 7E:
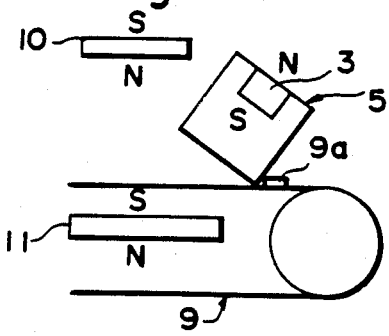
Figure 8:
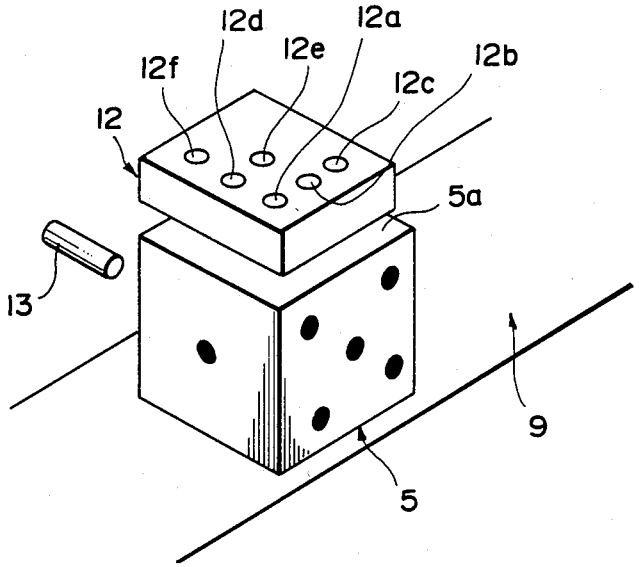
FIG. 8 is a perspective view showing the relationship among a die, a detector for sorting the dice by a predetermined number of spot(s) thereon, and an edge detector.

The posture of the die 5 placed on the third belt conveyor 9 is subjected to correction, if and when required, by the action of the pair of magnets 10 and 11 so as to turn upward the predetermined number of spot(s) 5*a* thereon (STEP 270). Magnet polarity is indicated in the drawings by conventional "N" and "S" designations. The procedure for correcting the posture of each die 5 will now be described below with reference to FIGS. 7A to 7F. When the die 5 has dropped from the second belt conveyor 6 onto the third belt conveyor 9 at a position designated by a mark "X" as shown in FIG. 7A, and its magnet 3 occupies its lowermost position, i.e., it is located adjacent to the transferring surface of the conveyor 9 as shown in FIG. 7B, the upper face of the die 5 indicates a predetermined number of spot(s) 5*a*, and so there is no need for correction. When the die 5 is located with the magnet 3 facing leftwards as shown in FIG. 7C, the attraction force of the magnet will cause a turning force effective in the direction shown by an arrow H to enable the predetermined number of spot(s) 5*a* thereon to turn easily upward. However, when the face of the die 5 having a predetermined number of spot(s) 5*a* occupies its lowermost position as shown in FIG. 7D, the above-mentioned turning force does not occur. In such a case, although the third belt conveyor 9 is moving in the direction shown by an arrow D, the die 5 is not allowed to move forwards by the repulsive force exerted by the magnet, and instead it is merely sliding on the third belt conveyor 9. But, when the small projection 9*a* fitted to the third belt conveyor strikes against the rear and lowermost edge of the die 5, the latter is inclined as shown in FIG. 7E, because its top surface is not allowed to move forwards, until the magnet 3 is located on the right side. Consequently, in the same manner as already mentioned with reference to FIG. 7C, the attraction force exerted by the magnet 3 will cause a turning force in the direction as shown by an arrow J to enable the predetermined number of spot(s) 5*a* thereon to turn upward.

When the dice edge detector 13 has detected the edge of the die 5 with its face having a predetermined number of spot(s) 5*a* thereon turned upward, the computer reads the output generated by six detecting units 12*a*, 12*b*, 12*c*, 12*d*, 12*e* and 12*f* (FIG. 8) located at positions corresponding to the spot on the half of the dice divided by the diagonal thereof, i.e., the detectors 12*a*–12*f* are arranged in a generally triangular configuration, thereby detecting the number of spot(s) 5*a* on the die (STEP 280). In an alternative embodiment, as depicted in FIG. 1, the detectors can be arranged in a 3×3 matrix configuration. The relationship between the output from each of the detecting units 12*a* to 12*f* of the spot detector 12 and the number of spot(s) 5*a* on the die 5 is shown in TABLE I. In the TABLE I, the reference character "0" represents "OFF", and "1" represents "ON".

TABLE I

| NUMBER OF SPOT(S) ON DICE 5 | SPOT DETECTOR 12 | | | | | |
|---|---|---|---|---|---|---|
| | 12a | 12b | 12c | 12d | 12e | 12f |
| 1 | 0 | 0 | 0 | | 1 | 0 |
| 2 | 0 | 0 | 1 | 0 | 0 | 1 |
| | 1 | 0 | 0 | 0 | 0 | 0 |
| 3 | 0 | 0 | 1 | 0 | 1 | 1 |
| | 1 | 0 | 0 | 0 | 1 | 0 |
| 4 | 1 | 0 | 1 | 0 | 0 | 1 |
| 5 | 1 | 0 | 1 | 0 | 1 | 1 |
| 6 | 1 | 1 | 1 | 0 | 0 | 1 |
| | 1 | 0 | 1 | 1 | 0 | 1 |

A detection signal is transmitted by the spot detector 12 to the gate controller 16 so that the gate 19 of the dice housing means corresponding to the predetermined number of spot(s) 5*a* on the die 5 is opened (STEP 290). At the same time, the die 5 drops from the third belt conveyor 9 in the direction shown by an arrow E onto the fourth belt conveyor 15 which is moved by means of the driving motor M4 in the direction shown by an arrow F, and then cast into a predetermined gate 19 (STEP 300).

When three spot(s), for example, on the die 5 are detected by the dice spot detector 12, the predetermined gate 19 of the dice housing means 18 is opened so that the die 5 resting on the fourth belt conveyor 15 is cast into the corresponding chamber 20 which houses dice indicating the spots on their side opposite the magnet 3. In this case, the time for casting the die 5 into the predetermined chamber 20 is pre-set by means of a timer (STEP 310). When the die 5 has been cast into the predetermined chamber 20, the predetermined gate 19 is shut off (STEP 320), and at the same time the driving motor M4 is stopped to stop the fourth belt conveyor 15 (STEP 330).

The five dice 5 are cast in turn into their respective predetermined gates 19 according to the above-mentioned procedure. Then, it is discriminated whether all the five dice 5 have been cast into their respective chambers 20 (STEP 340). Until it is discriminated that all the five dice 5 have been cast into their respective chambers 20, the loop ② is executed. After detecting that all the five dice 5 have been cast into their respective chamber 20, the driving motor M5 is stopped to stop the first belt conveyor 2. Loop (3) is subsequently executed to begin another game with the generation of another set of five numbers.

The present invention is not to be limited to the embodiment shown in the drawings, and a variety of changes and modification can be made without departing from the scope and spirit of the invention. For example, the shape of the dice is not to be limited to the regular hexahedron, as any polyhedric dice having letters, marks or colors etc. applied to their respective facets, or spherical dice with their upper and lower faces classified by identification colour may be used to make a variety of similar automatic playing machines.

According to the present invention, the probability of each of the six spot(s) on the dice appearing in a game can be accurately set at a ratio of 1/6. Since dice to indicate a predetermined number of spot(s) can be taken out by the command of the computer, the probability of each of the six kinds of spot(s) on the dice appearing in a game can be varied according to the purpose of the game. Accordingly, the automatic playing machine according to the present invention can be used for a variety of games, lottery or the like.

What is claimed is:

1. An automatic playing machine for dice, comprising:

a dice board member;

a magnetic field generating means disposed in the periphery of said board member for applying an electromagnetic force to said board member;

a plurality of dice, each of said dice comprising a first side for resting on said board member, a second side generally opposite said first side having one of a plurality of predetermined numbers of spots thereon, and a magnet mounted therein which cooperates with said applied electromagnetic force such that, when each of said dice is cast and rests upon said broad member, said second side thereof indicates said predetermined number of spots, said plurality of dice being arranged in groups having on their respective second sides thereof a variety of different predetermined numbers of spots;

dice housing means for accommodating each of said groups of said dice in accordance with said respective predetermined numbers of spots on said second sides thereof;

computer means for generating and storing at least one of said respective predetermined numbers of spots;

dice ejecting means for removing from said dice housing means at least one of said dice having one of said predetermined number of spots on said second side thereof corresponding to at least one of said numbers generated by said computer means;

dice casting means for dispensing said dice ejected from said dice housing means onto said board member;

means for recovering said dice from said board member and for transferring said dice to said dice housing means; and means for identifying and sorting said recovered dice in accordance with said respective predetermined numbers of spots on said second sides thereof and for delivering said dice to said housing means for storage therein.

2. An automatic playing machine according to claim 1, wherein said dice recovering and transferring means comprises a first, selectively operable belt conveyor for serving as a board member when at rest and for serving as a dice recovering means during belt conveyor operation; a second belt conveyor disposed below said first belt conveyor so as to transfer said recovered dice to said means for sorting said dice in accordance with said predetermined number of spots thereon; a third belt conveyor disposed below said second belt conveyor and adjacent said sorting means, said third belt conveyor having a transfer surface for transferring said dice therefrom; and a fourth belt conveyor for transferring said sorted dice to said dice housing means.

3. An automatic playing machine according to claim 2, wherein means is provided for controlling the posture of each of said dice transfered to said third belt conveyor so as to position said second dice side having said predetermined number of spots thereon adjacent to said identifying means.

4. An automatic playing machine according to claim 3, wherein said dice posture controlling means comprises a pair of magnets positioned above and below the transfer surface of said third belt conveyor.

5. An automatic playing machine according to claim 4, wherein said dice posture controlling means further comprises dice tumbling means provided on said third belt conveyor.

6. An automatic playing machine according to claim 1, wherein said means for sorting dice by said predetermined number of spots thereon comprises a dice surface detector adapted to read the number of spots on the second side of each of said dice and generate a detection signal in response thereto, and gate means for opening and closing said gates of said dice housing means in accordance with said detection signal.

7. An automatic playing machine according to claim 6, wherein said dice surface detector comprises at least six detecting units arranged in a generally right triangular configuration and located at positions corresponding to the locations of the spots on a right triangular half of the second side of the die.

8. An automatic playing machine according to claim 7, wherein a dice edge detector for confirming the positional coincidence of each of said dice with at least said dice detecting units is provided.

9. An automatic playing machine according to claim 1, wherein means is provided for displacing said dice casting means in a substantially vertical manner such that the dice ejected from said housing means are received at a lower position with respect to an upper position from which they are cast.

10. An automatic playing machine according to claim 1, wherein at least one of said dice is in the shape of polyhedron having different markings applied thereon.

11. An automatic playing machine according to claim 6, wherein said dice housing means comprises a plurality of chambers for accommodating dice in accordance with the number of spots on the second side thereof.

12. An automatic playing machine according to claim 6, wherein said dice surface detector comprises nine spot detecting areas arranged generally in a $3 \times 3$ square matrix configuration so as to detect an integer number of spots ranging from one to six arranged on said second side of said dice.

* * * * *